US007410450B1

(12) United States Patent
Paulding

(10) Patent No.: US 7,410,450 B1
(45) Date of Patent: Aug. 12, 2008

(54) PORTABLE ELASTIC RESISTANCE EXERCISE APPARATUS

(76) Inventor: Kenneth F. Paulding, 2527 Highland Ave., Kissimmee, FL (US) 34741

( * ) Notice: Subject to any disclaimer, the term of this patent is extended or adjusted under 35 U.S.C. 154(b) by 229 days.

(21) Appl. No.: 11/340,331

(22) Filed: Jan. 27, 2006

(51) Int. Cl.
*A63B 21/02* (2006.01)

(52) U.S. Cl. ..... 482/121; 482/120; 482/910

(58) Field of Classification Search ..... 482/114, 482/120–126, 129–130, 907, 910
See application file for complete search history.

(56) References Cited

U.S. PATENT DOCUMENTS 3,472,510 A * 10/1969 Holkesvick ..... 482/120
3,510,132 A * 5/1970 Holkesvick ..... 482/120
5,212,842 A * 5/1993 Glydon ..... 5/420
6,267,711 B1 7/2001 Hinds
2003/0186792 A1* 10/2003 Keeler ..... 482/129
2005/0113222 A1 5/2005 Dovner
2005/0130814 A1 6/2005 Nitta et al.
2006/0194679 A1* 8/2006 Hatcher ..... 482/123
2007/0087920 A1* 4/2007 Dachraoui et al. ..... 482/123

* cited by examiner

*Primary Examiner*—LoAn H. Thanh
*Assistant Examiner*—Ryan Durcik

(57) ABSTRACT

A portable elastic resistance exercise apparatus comprising two panels selectively affixed in a 90 degree angle. Both panels are padded for user interaction. Elastic resistance is positioned as chosen within cutouts in the back panel, at any height and with any resistance chosen. Grips on the resistance enable either grasping or hooking around limbs or body parts. The apparatus folds for portability and also includes non-skid and other anchoring devices for temporary affixation to foreign objects and surfaces. The apparatus therefore offers a truly portable, all-in-one exercise device.

16 Claims, 5 Drawing Sheets

PORTABLE ELASTIC RESISTANCE EXERCISE APPARATUS

BACKGROUND OF THE INVENTION

A plethora of exercise devices has been offered since man first began to try to improve or rehabilitate his/her body. Such offerings have proliferated even farther in recent years. Portable exercise devices encompass a great number of such. The art is therefore crowded with a countless number of truly varied offerings. True lightweight portability, though, is difficult to obtain. It is even more difficult to obtain such in a compact and easy-to-carry size and weight. Typically, a truly portable device that is sized and weighted for easy and convenient transport is prohibitive. Further, such devices normally offer only limited body part conditioning and exercise choices. A portable sit-up exercise device is a prime example of a limited use device. A device which offers unlimited body part involvement is truly rare. Unlimited resistance choice is virtually non-existent in any device which might otherwise fulfill all of the above listed criteria.

The present invention uniquely offers true lightweight portability, collapsibility, convenience, unlimited exercise choices, unlimited resistance choices, and even features for anchoring the device with regard to self, surfaces, and foreign objects. The present invention is therefore a true all-in-one exercise apparatus.

1. Field of the Invention

The present invention relates to portable exercise equipment and more specifically to a portable exercise apparatus featuring elastic resistance.

2. Description of the Prior Art

Exercise devices, and especially portable exercise devices abound in the marketplace and have for years. While many are quite similar, still others vary greatly in their methods of imposing resistance against physical movement. These devices also differ greatly in their attempts to anchor themselves to some solid object 90 (FIG. 8) or even temporarily to a user. Differences also abound in true portability, collapsible or non-collapsible capabilities, range of movement, and a host of other traits. While the present invention is similar in the respect that resistance is imposed by elastic members, other design and functional traits differ greatly from prior art. As example:

U.S. Pat. No. 6,267,711 to Hinds on Jul. 31, 2001 discloses an elastic cord exercise assembly optionally capable of mounting on a door face. The device distinctly points out and claims guide rails, and further employs channels and pulleys. With the exception of the elastic cord usage, all other design parameters of the assembly differ totally from the present invention.

U.S. Pat. No. 2005/0130814 to Nitta, et al issued on Jun. 16, 2005 discloses an exercise device utilizing an elastic resistance device. The device also comprises a coupled frame and platform with a coupling device. The similarities in design and function with the present invention end here.

U.S. Pat. No. 2005/0113222 to Dovner et al on May 26, 2005 discloses a device utilizing elastomeric tubing for resistance. The device similarities with the present invention herein end.

While the above-described devices fulfill their respective and particular objects and requirements, they do not describe a portable elastic resistance exercise apparatus that provides for the advantages of the present invention, therefore, a need exists for an improved portable elastic resistance exercise apparatus. In this respect, the present invention substantially departs from the conventional concepts and designs of the prior art.

SUMMARY OF THE INVENTION

The general purpose of the portable elastic resistance exercise apparatus, described subsequently in greater detail, is to provide a portable elastic resistance exercise apparatus which has many novel features that result in an improved portable elastic resistance exercise apparatus which is not anticipated, rendered obvious, suggested, or even implied by prior art, either alone or in combination thereof.

In view of the foregoing disadvantages inherent in the known types of portable resistance exercise apparatuses now present in the prior art, the improved portable elastic resistance exercise apparatus overcomes the above-mentioned disadvantages and drawbacks or the prior art. As such, the general purpose of the improved portable elastic resistance exercise apparatus, described subsequently in greater detail, is to provide a new and improved portable elastic resistance exercise apparatus which has all of the advantages of the prior art mentioned heretofore and many novel features that result in an improved portable elastic resistance exercise apparatus which is not anticipated, rendered obvious, suggested, or even implied by the prior art, either alone or in combination thereof.

To attain this, the present invention essentially comprises two parallelepiped panels. The front panel is, in the most basic offering, fastened to the back panel at a 90 degree angle, although such is not mandatory, and other established angles or no established angle at all is available.

In the preferred examples, the panels are hingedly fastened such that the apparatus' panels are folded to face each other when not in use. In use, the panels are available at various angles with respect to each other. The primarily utilized example of the invention selectively affixed in a 90 degree angle to each other. Each panel is padded for user interaction. A hinged retainer is used to brace the panels with respect to each other. Hinges used are arranged such that the back panel and the retainer are limited to 90 degrees of movement, in the preferred example. The back panel of the invention features a plurality of cutouts such that the elastic resistance can be arranged in virtually any length and with resistance that a user desires. Cutouts are arranged in mirrored alternating rows along either side of the back panel. The preferred resistance employed is Bungee™ cords, however; and elastic cord may be utilized. Grips are offered which allow either grasping by a user or hooking around a given body limb or extremity. Virtually any imagined exercise can be performed using the infinitely variable resistance provided by user choice. Holes for locking the invention in an open position, as well as holes for locking the invention against movement itself are offered, along with dowels for use in such holes. These features, the collapsibility, and the light weight offer true portability unknown in the art. The invention is made in varied examples of materials, with plastic or polymers being the preferred choices.

Thus has been broadly outlined the more important features of the improved portable elastic resistance exercise apparatus so that the detailed description thereof that follows may be better understood and in order that the present contribution to the art may be better appreciated.

These together with additional objects, features and advantages of the improved portable elastic resistance exercise apparatus will be readily apparent to those of ordinary skill in the art upon reading the following detailed description of presently preferred, but nonetheless illustrative, embodiments of the improved portable elastic resistance exercise apparatus when taken in conjunction with the accompanying drawings. In this respect, before explaining the current embodiments of the improved portable elastic resistance exercise apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and systems for carrying out the several purposes of the improved portable elastic resistance exercise apparatus. It is therefore important that the claims be regarded as including such equivalent constructions insofar as they do not depart from the spirit and scope of the present invention.

Objects of the improved portable elastic resistance exercise apparatus, along with various novel features that characterize the invention are particularly pointed out in the claims forming a part of this disclosure.

For better understanding of the improved portable elastic resistance exercise apparatus, its operating advantages and specific objects attained by it uses, refer to the accompanying drawings and description.

It is an object of the portable elastic resistance exercise apparatus to be lightweight.

It is a further object of the portable elastic resistance exercise apparatus to be collapsible.

It is therefore an object of the portable elastic resistance exercise apparatus to provide true convenient portability.

It is an added object of the portable elastic resistance exercise apparatus to provide for temporarily anchoring the apparatus for use.

It is a further object of the portable elastic exercise apparatus to provide for an infinite number of varied exercise movements against resistance.

It is still another object of the portable elastic resistance exercise apparatus to provide for infinite variability in the amount of exercise resistance provided.

Finally, it is an object of the portable elastic resistance exercise apparatus to provide for a total physical workout.

Thus has been broadly outlined the more important features of the portable elastic resistance exercise apparatus so that the detailed description thereof that follows may be better understood and in order that the present contribution to the art may be better appreciated.

Numerous objects, features and advantages of the portable elastic resistance exercise apparatus will be readily apparent to those of ordinary skill in the art upon reading the following detailed description of presently preferred, but nonetheless illustrative, examples of the portable elastic resistance exercise apparatus when taken in conjunction with the accompanying drawings. In this respect, before explaining the current examples of the portable elastic resistance exercise apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the portable elastic resistance exercise apparatus.

It is therefore important that the claims be regarded as including such equivalent constructions insofar as they do not depart from the spirit and scope of the present invention.

Objects of the portable elastic resistance exercise apparatus, along with various novel features that characterize the invention are particularly pointed out in the claims forming a part of this disclosure. For better understanding of the portable elastic resistance exercise apparatus, its operating advantages and specific objects attained by its uses, refer to the accompanying drawings and description.

DETAILED DESCRIPTION OF THE DRAWINGS

With reference now to the drawings, and in particular FIGS. 1 through 8 thereof, example employing the principles and concepts of the present invention and generally designated by the reference number 10 will be described.

Figure 1:
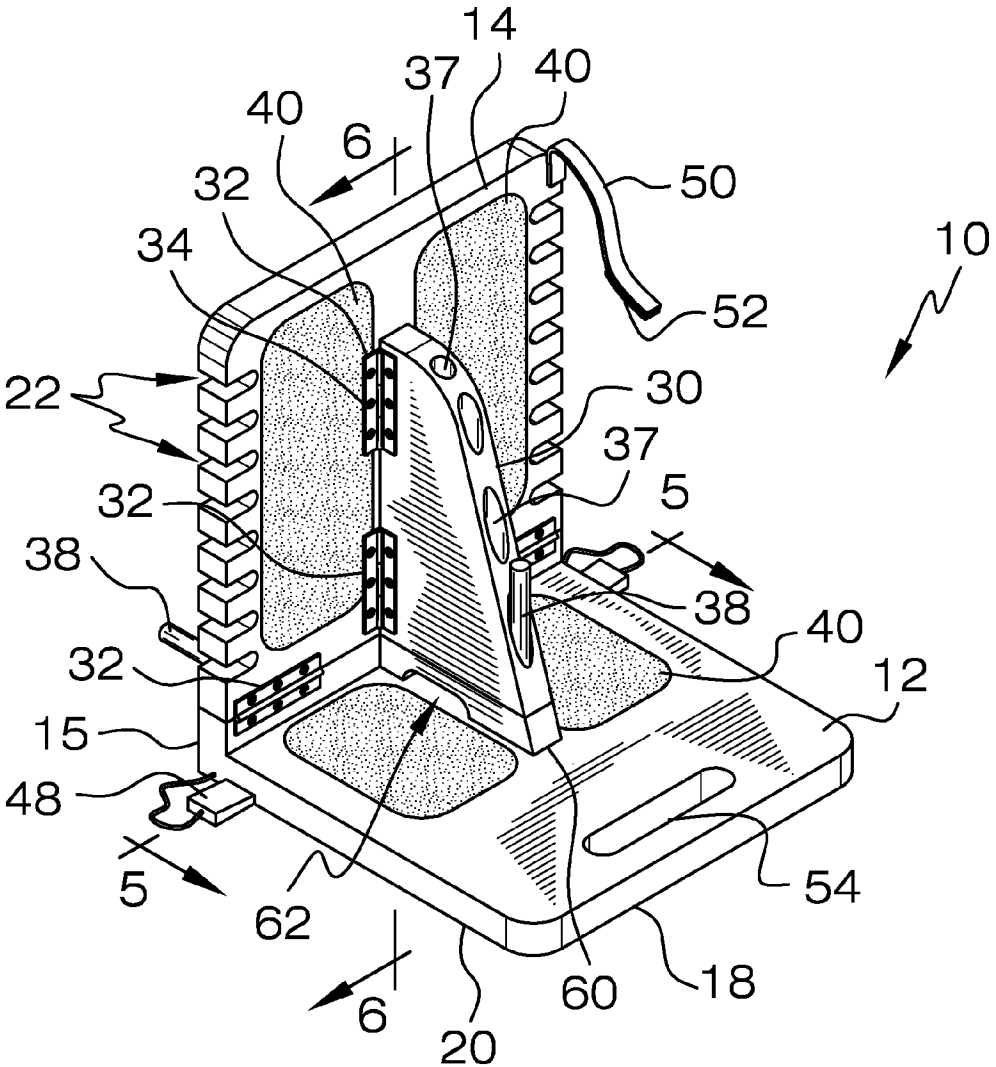
FIG. 1 is a perspective view with the retainer in position supporting the front and back panels open at about 90 degrees relative to each other.
Figure 2:
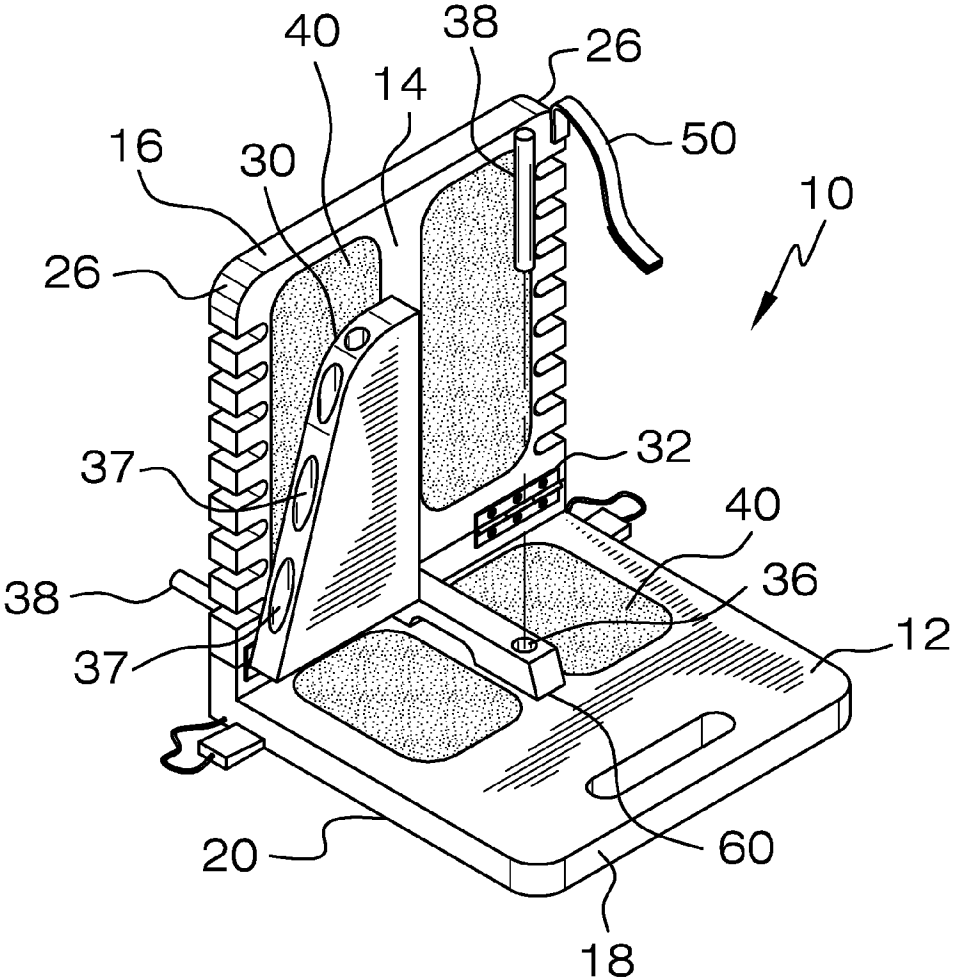
FIG. 2 is a perspective view with the retainer in a position which does not affix the panels in an open position.

Referring to FIGS. 1 and 2, the invention 10 comprises a portable, collapsible, elastic resistance exercise apparatus. The invention 10 further comprises a parallelepiped front panel 12 and a parallelepiped back panel 14. The front panel 12 and the back panel 14 each have a spaced apart top 16 and bottom 18. Each of both the front panel 12 and the back panel 14 further comprise two spaced apart opposing sides 20. The top 16 of the front panel 12 is connected to the bottom 18 of the back panel 14 in a basic example of the invention 10. Basic examples of the invention 10 offer either rigid connection of the front panel 12 to the back panel 14, at about 90 degrees, or even a hinged connection of the front panel 12 to the back panel 14 with free angular positioning. In the preferred example illustrated, the elbow 15 is disposed on the top 16 of the front panel 12. The elbow 15 then forms a right angle to the planar surface of the front panel 12. The top 16 of the elbow 15 then selectively mates with the bottom 18 of the back panel 14. The elbow 15 is further comprised of a height above the top surface of the front panel 12. A hinge 32 is preferably disposed proximal to each opposing side 20 of the front panel 12 and the back panel 14. Each hinge 32 is fastened to a top of the elbow 15 of the front panel 12 and to the bottom 18 of the back panel 14. The hinged retainer 30 is hingedly fastened to the top surface of the back panel 14 via hinges 32 and fasteners 34. The back of the triangulated hinged retainer 30 is secured along the height of the back panel 14 such that pivoting of the retainer 30 to lock into position for securing the angle between the front panel 12 and the back panel 14 positions the retainer 30 directly above an in alignment with the retainer support 60. The retainer support 60 is further comprised of an orifice 62 for the optional use of a belt (not shown) or the like to secure the invention 10 to any chosen device or furniture item. The hinged retainer 30 selectively and hingedly braces an angle between the front panel 12 and the back panel 14. While the preferred angle is about 90 degrees, various retainers 30 are offered with varying degrees of maintenance of the front panel 12 relative to the back panel 14. FIG. 1 illustrates the folded out hinged retainer 30 for holding the thereby established angle between the front panel 12 and the back panel 14.

FIG. 2 illustrates the hinged retainer 30 folded inward against the back panel 14. As the thickness of the hinged retainer 30 is equal to or less than that of the height of the retention support 60, the front panel 12 and the back panel 14 of the invention 10 are capable of collapsing together about the hinge 32 joining the two (FIG. 3) without impediment. The insertion of the locking dowel 38 into the corresponding holes of the hinged retainer 30 and the retainer support 60 provide for locking the hinged retainer into place for holding the front panel 12 and the back panel 14 in the required angle or comparative arrangement of same. Removing the locking dowel 38 from the locking holes 36 provided for the retainer to be pivoted about the retainer 30 hinges 32 such that the retainer 30 is allowed to be positioned coplanar to the height of the back panel 14. The retainer 30 then allows for the front panel 12 and the back panel 14 to be positioned flexibly in any relative angular position. A full collapse of the front panel 12 to the back panel 14 is allowed by the full collapse of the retainer 30 against the top surface of the back panel 14. The pivotal relationship of the retainer 30 with the back panel 14 provides for clearance beyond the retainer support 60 enabling such. The retainer support 60 is disposed on the top surface of the approximate center of the front panel 12. The retainer support 60 is at a height equal to that of the top of the elbow 15. Both the front panel 12 and the back panel 14 are preferably rounded at the corners exposed to a user 80. A plurality of cutouts 22 is disposed within each side 20 of the back panel 14. At least two elastic resistance 58 devices are employed. Elastic resistance 58 is comprised of elastic cords known in several arts as Bungee™, rubberized cords, or the like. Bungee™ cords are preferred, as they are offered with color codes, with color coded cords available in different lengths and resistance. One of each elastic resistance 58 is removably anchored within one of each of the opposing sides 20 of the back panel 14. Each elastic resistance 58 is anchored via at least one of the cutouts 22 of a side 20 of the back panel 14. The plurality of cutouts 22 is arranged from significantly top 16 to bottom 18 of each side 20 of the back panel 14. An elastic resistance 58 may be knotted at one end with the grip 56 on the opposite end. The grip 56 also serves as a hook for a user 80, whereby the user may hook a limb such as a leg or arm within the loop of the elastic resistance 58 formed by the resistance 58 and the grip 56. The elastic resistance 58 is passed through the grip 56 and fastened back to itself by any appropriate means. The knotted end of the resistance 58 can be used to lock the resistance 58 within any cutout 22. Further, the resistance 58 can be passed through a number of cutouts 22 and anchored thereby via friction. Both the height of the grips 56 and the force of the elastic resistance 58 are regulated by the amount of elastic left exposed between the grips 56 and the back panel 14. Pulling against the elastic resistance 58 imposes resistance to a user's 80 physical movements. Movements employed and resistance offered is limited only by the imagination of a user 80. A list of potential exercises to be performed by the user 80 include but are not limited to exercises for: deep knee bends, lower back and gluteus, lattissimus dorsi and other back muscles, toe raises, oblique muscles, wrist and forearms, situps, bicep and leg curls, pectoralis exercises, arm presses, tricep extensions, and the like. Almost; any human movement can be resisted by the invention 10. The carry handle 54 is disposed proximal to the bottom 18 of the front panel 12. The carry handle 54 is comprised of an opening in the front panel 12. The user pads 40 are preferably disposed in pairs on both the upper surface of the front panel 12 and the upper surface of the back panel 14. Thereby a cushioned surface is provided for interactive contact with a user 80. Preferably, a pair of spaced apart user pads 40 constitutes a substantial amount of the top surface of the back panel 14. Pads 40 are preferably of rectangular shape with rounded corners 26. A like pair of user pads 40 is disposed on the top surface of the front panel 12. User pads 40 of the front panel 12 require division by the presence of the retainer support 60 between. User pads 40 provide cushioning of body contact of a user 80 for better utilization of the invention 10. Non-skids 42 of the front panel 12 are preferably of like shapes to user pads 40 on the top surface of the front panel 12. Non-skids 42 are provided on the bottom surface (FIG. 4) of the front panel 12 so that the invention 10 does not slip when placed upon any surface, especially a potentially slick one.

Figure 3:
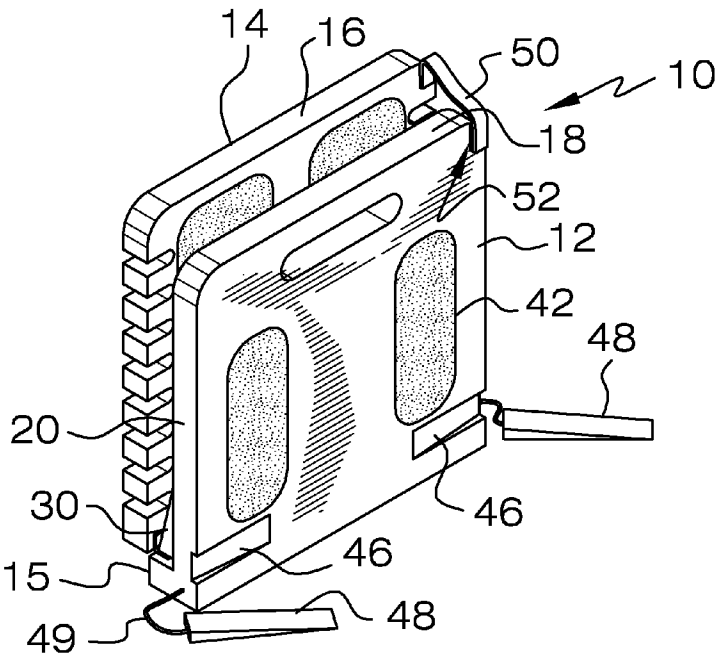
FIG. 3 is a perspective view with the panels in a collapsed position.

Referring to FIG. 3, the invention 10 is in the folded or collapsed position. A wedge slot 46 is disposed proximal to each side 20 of the front panel 12. Each slot 46 is disposed within a bottom of the elbow 15 at the top 16 of the front panel 12. Each slot 46 decreases in depth as each slot 46 becomes more proximal to the center of the front panel 12. Two wedges 48 are provided. Each wedge 48 is of like shape to each wedge slot 46. Each wedge 48 is removably and selectively inserted as chosen into each slot 46.

The depth of insertion of each wedge 48 determines function in both leveling and adjusting the fit of the front panel 12 regarding floors, positioning of the invention 10 proximal to furniture and obstacles and the like. As each wedge 48 is inserted farther into each wedge slot 46, the top 16 of the front panel 12 is further elevated. Each wedge 48 is retained against loss via a retaining cord 49. Each retaining cord 49 is fastened to an opposing side 20 of the front panel 12. Wedges 48 can be inserted between the front panel 12 and the back panel 14 when the invention 10 is collapsed. Additionally, the preferable attachment of the closure strap 50 is permanent affixation to the back panel 14, proximal to the top 16 of back panel 14. The strap is then available for securing to the front panel 12, upon collapse of the invention 10, via hook and loop 52, which provides ease in retaining the collapsed orientation.

Figure 4:
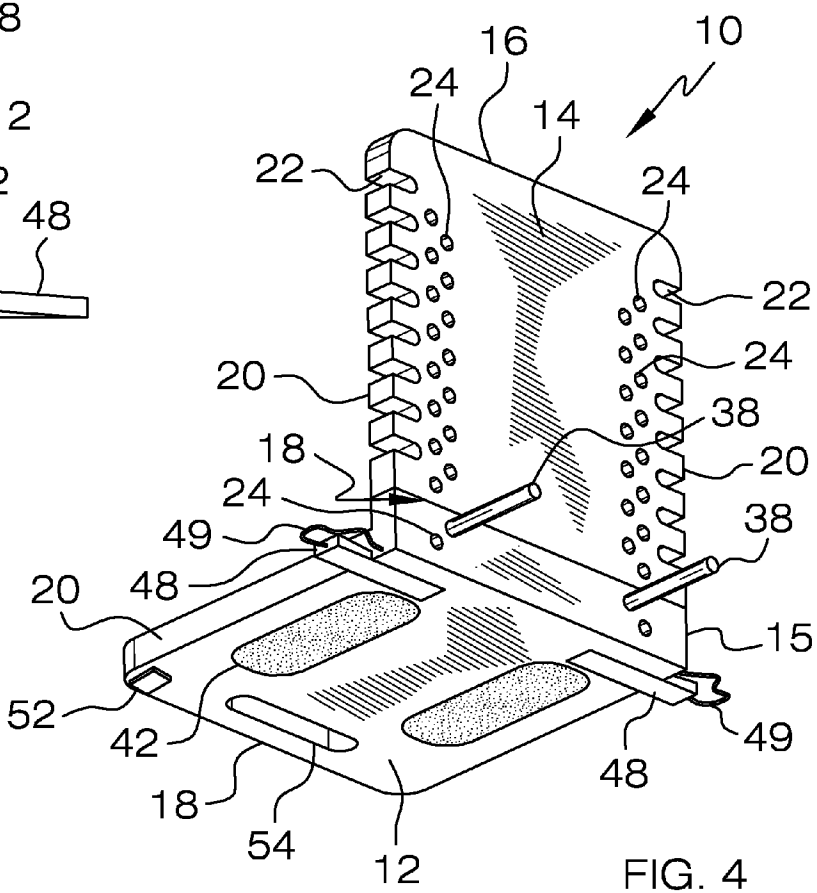
FIG. 4 is a perspective view of the back panel and elbow featuring peg holes, and with wedges inserted into the wedge slots.

Referring to FIG. 4, the bottom surface of the back panel 14 includes peg holes 24. The peg holes 24 are arranged proximal to each side 20 of the back panel 14. The peg holes 24 are arranged in a mirrored offset pattern. The peg holes 24 are substantially from a top to a bottom of the back panel 24. The peg holes 24 provide for removable insertion of the locking dowels 38. The invention 10 is thereby positioned proximal to furniture items. The locking dowels 38 are inserted as needed into the peg holes 24 such that the invention 10 is restrained from lifting from the furniture item. A typical example of locking dowel usage might be positioning the invention 10 next to a couch, with the invention 10 in the open position with regard to the front panel 12 and back panel 14. The bottom surface of the back panel 14 is positioned proximal to the couch.

Locking dowels 38 are inserted into the chosen peg holes 24 and under a couch bottom ledge, for example. The invention 10 is thereby prevented from lifting. The elbow 15 is further comprised of a plurality peg holes 24. The peg holes 24 are arranged proximal to each side of the elbow 15. The peg holes 24 continue in a pattern of the peg holes 24 of the back panel 14. Wedges 48 are partially inserted into wedge slots 46, respectively. Further, wedges 48 are also offered in non-skid materials to aid in anchoring the invention 10 in use. The hook and loop 52 proximal to the bottom 18 of the front panel 12 is provided for temporarily affixed the closure strap 50. Non-skids 42 aid in anchoring the invention 10 against movement when the invention 10 is placed upon a given surface.

Figure 5:
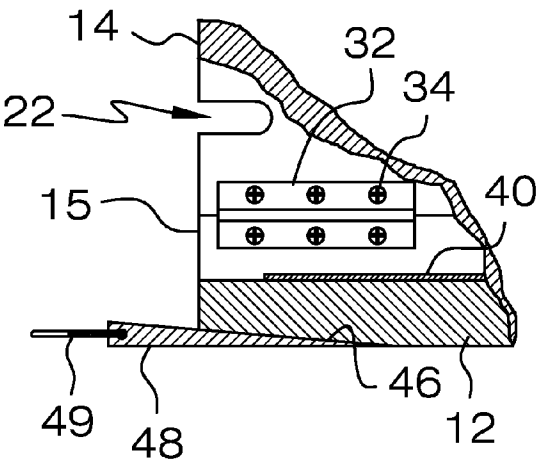
FIG. 5 is a cross sectional view of the hinges and wedges of FIG. 1, taken along the line 5-5.

Referring to FIG. 5, the depiction of wedge 48 usage illustrates that partial insertion of a wedge 48 into the wedge slot 46 enables the front panel 12 to rest upon a surface in a flat manner. Further insertion of the wedge 48 would elevate the top 16 of the front panel 12. The hinge 32 is retained via typical fasteners 34. Hinges 32 may be retained by any number of methods known in the art. The user pad 40 is slightly elevated with regard to the top surface of the front panel 12.

Figure 6:
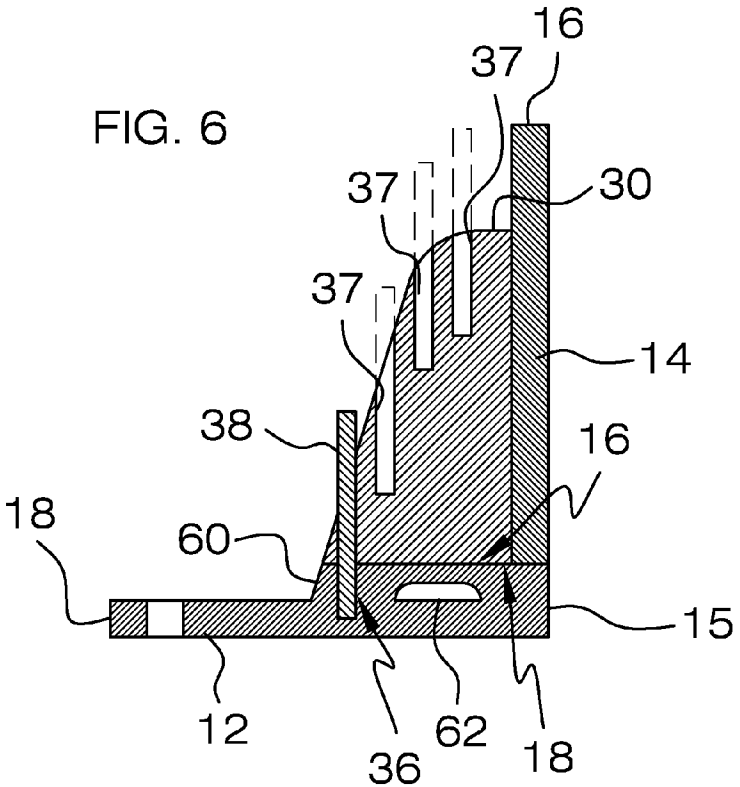
FIG. 6 is a cross sectional view of the retainer with locking dowel inserted into locking holes, of FIG. 1, taken along the line 6-6.

Referring to FIG. 6, the locking dowel 38 is inserted into the locking holes 36 of both the hinged retainer 30 and the locking hole 36 of the retainer support 60. Orifice 62 provides for the insertion of a belt or the like in holding the front panel 12, and therefore the invention 10, to a chosen object 90 (FIG. 8) or surface. The storage holes 37 are included in the hinged retainer 30 so that unused locking dowels 38 may be stored when not used.

A plurality of storage holes 37 provides for the storage of a plurality of locking dowels 38 for use in both the locking holes 36 and the peg holes 24.

Figure 7:
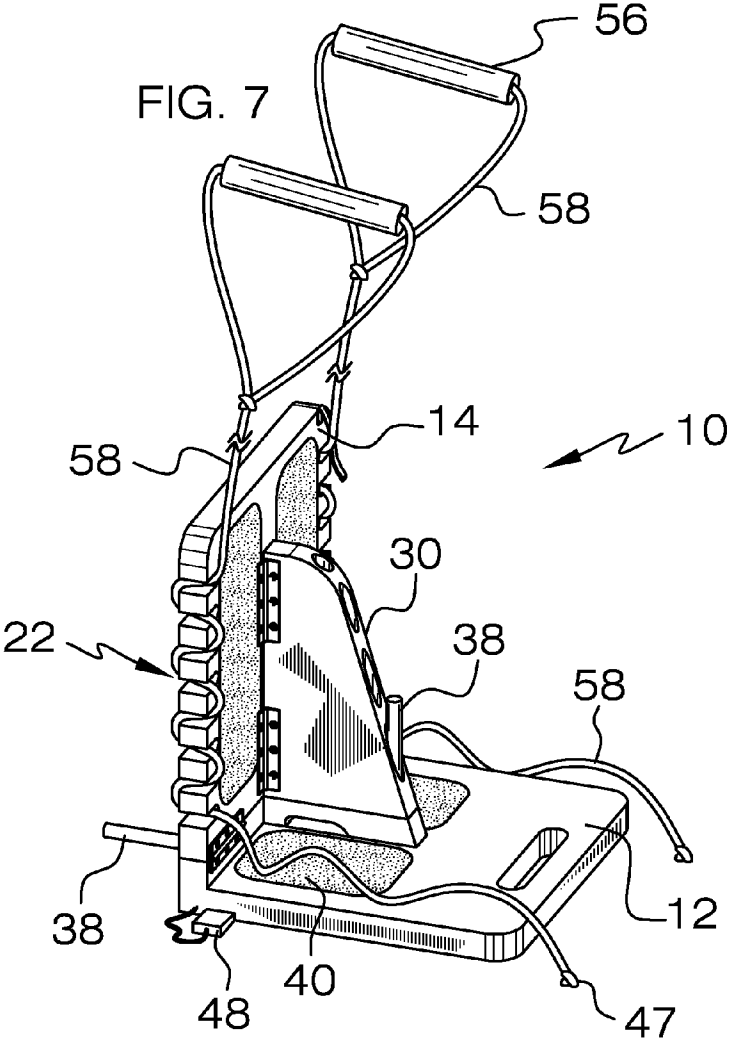
FIG. 7 is a perspective view including the elastic resistance with grips.

Referring to FIG. 7, an elastic resistance 58 is temporarily affixed within a plurality of cutouts 22 of each side 20 of the back panel 14. Use of a plurality of cutouts 22 negates the need to anchor a knot 47 against a cutout 22 in order to secure the resistance 58. The elastic resistance 58 is secured via friction. However, as shorter resistance 58 may be employed, the choice of cutout 22 use in number and location is determined by the user 80. The chosen anchorage of the resistance 58 exit from a given cutout 22 determines the height of the grip 56. Grip 56 heights determine a user's 80 beginning orientation in resistance 58 usage.

Figure 8:
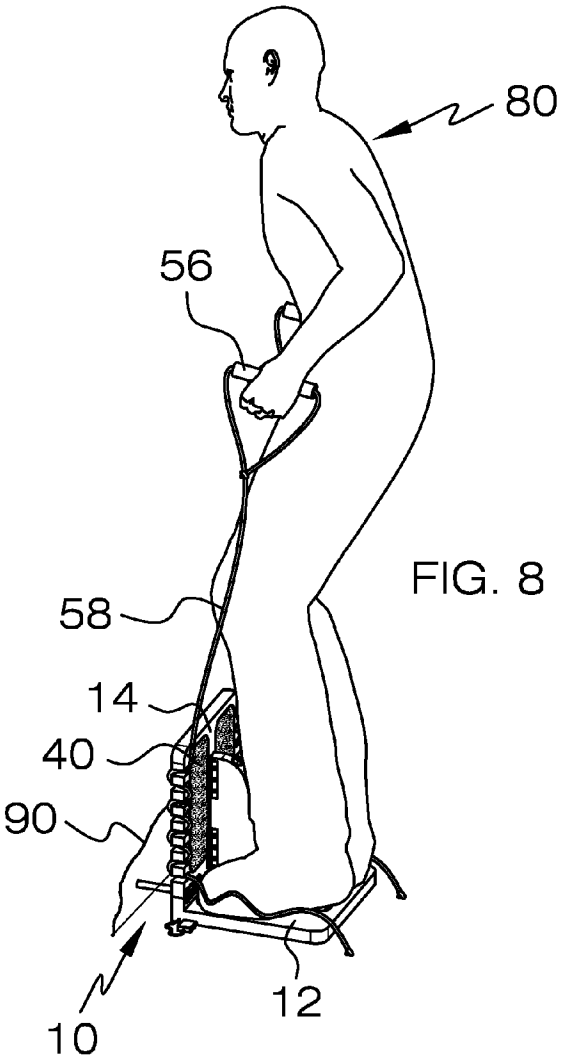
FIG. 8 is a perspective view with user.

Referring to FIG. 8, the user 80 is pictured in preparation of elevating the grips toward a shoulder height. Slack in each resistance 58 is represented, as the user 80 has yet to elevate the grips 56 to that height. In continuing the raise the grips 56 to the shoulders, a given amount of preload is thereby offered by the resistance 58, thereby offering an initial amount of force opposing a user 80 pressing the grips 56 above the shoulders in a shoulder press exercise. Should the resistance prove insufficient for the user 80, the elastic resistance 58 may be either woven back through additional or lower cutouts 22 or the user 80 may choose to lower the beginning height of the grips 56. Because of this feature, the user 80 may also vary the resistance 58 provided against one grip 56 versus the other, or even use only one grip 56 at a time. Offering resistance 58 against the movement of only one body part provides greater versatility in exercise choice, for whatever the reason.

A locking dowel 38 is inserted into a peg hole 24 of the elbow 15 and is used to anchor the invention 10 to a foreign object 90. The user 80 is standing substantially upon the user pads 40 of the top surface of the front panel 12. The hinged retainer 30 is in position to lock the approximate 90 degree angle between the front panel 12 and the back panel 14. As further example, the user 80 could just as easily have positioned the grips closer to the back panel 14 in a starting position for grasping the grips and performing a squat, which is well known in the art. The user 80 would begin with bent knees, holding onto the grips 56, then straighten the legs against the resistance 58, bending the legs and flexing the hips back to the starting position in preparation of another repetition. Any number of body and limb positions may be assumed in utilizing the varied placement and amount of resistance offered by the invention 10 against such movement. As further example, the user could just as easily position himself/herself in a prone position with feet against the user pads 40 of the back panel. The user can then pull against the resistance 58, away from the back panel 40. Grips 56 may be used to hook feet or ankles, as additional example, in resisting countless leg movements or arm movements, with the resistance provided against movement limited only by user 80 imagination.

With respect to the above description then, it is to be realized that the optimum dimensional relationships for the parts of the portable elastic resistance exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable, elastic resistance exercise apparatus, comprising:

a parallelepiped front panel and a parallelepiped back panel, the front panel and the back panel each having a spaced apart top and bottom, and two spaced apart opposing sides, the top of the front panel connected to the bottom of the back panel;

a plurality of cutouts disposed within each side of the back panel;

at least two elastic resistance devices, one of each resistance device removably anchored within one of each of the opposing sides of the back panel, each resistance device anchored via at least one of the cutouts of the side of the back panel;

means for grasping or hooking each resistance device to a user, whereby resistance to a user's physical movement is provided, wherein the front panel is fastened to the back panel by at least one hinge, each hinge disposed proximal to the top of the front panel and the bottom of the back panel, whereby the exercise apparatus is collapsible, wherein the front panel is selectively braced in an open position relative to the back panel via a movable hinged retainer, the retainer fastened to one of the panels, wherein the hinged retainer selectively holds the front panel open at about a 90 degree angle to the back panel, wherein the hinged retainer is further comprised of a vertical locking hole;

a corresponding locking hole in a top surface of the front panel;

a locking dowel for removable insertion into the locking holes.

2. The apparatus in claim 1 wherein the hinged retainer is hinged to the back panel.

3. A portable, collapsible, elastic resistance exercise apparatus, comprising:

a parallelepiped front panel and a parallelepiped back panel, the front panel and the back panel each having a spaced apart top and bottom, and two spaced apart opposing sides, each panel having a top surface and a bottom surface;

a parallelepiped elbow of the front panel, the elbow disposed at the top of the front panel;

a hinge fastening a top of the elbow of the front panel to the top surface of the top of the back panel;

a hinged retainer selectively bracing an angle between the front panel and the back panel, the retainer facing the top surface of each panel;

a retainer support disposed on the top surface of an approximate center of the front panel, the retainer support at a height equal to that of the top of the elbow, a plurality of cutouts disposed within each side of the back panel;

at least two elastic resistance devices, one of each resistance device removably anchored within one of each of the opposing sides of the back panel, each resistance device anchored via at least one of the cutouts of the side of the back panel;

means for grasping and hooking each resistance device to a user, whereby resistance to a user's physical movement is provided.

4. The apparatus in claim 3 wherein the hinged retainer selectively holds the front panel open at about a 90 degree angle to the back panel.

5. The apparatus in claim 4 wherein the hinged retainer is further comprised of a vertical locking hole;

a corresponding locking hole in the front panel;

a locking dowel for removable insertion into the locking holes, a plurality of storage holes vertically disposed in the hinged retainer, the holes for storing locking dowels.

6. The apparatus in claim 3 wherein the hinged retainer is hinged to the back panel.

7. The apparatus in claim 4 wherein the hinged retainer is hinged to the back panel.

8. The apparatus in claim 5 wherein the hinged retainer is hinged to the back panel.

9. The apparatus in claim 8 wherein the back surface of the back panel is further comprised of a plurality of peg holes, the peg holes arranged along a height of the back panel proximal to each side of the back panel;

a plurality of locking dowels for the removable insertion into the peg holes.

10. The apparatus in claim 9 wherein a back surface of the elbow is further comprised of a plurality peg holes, the peg holes arranged proximal to each of a side of opposing sides of the elbow, the peg holes continuing a pattern of the peg holes of the back panel.

11. The apparatus in claim 10 wherein the front panel is further comprised of pads on the top surface of the front panel.

12. The apparatus in claim 11 wherein the back panel is comprised of pads on the front surface of the back panel.

13. A portable, collapsible, elastic resistance exercise apparatus, comprising:

a parallelepiped front panel and a parallelepiped back panel, the front panel and the back panel each having a spaced apart top and bottom, and two spaced apart opposing sides, each panel having a top surface and a bottom surface;

an elbow of the front panel, the elbow disposed at the top of the front panel;

a hinge fastening a top of the elbow of the front panel to the bottom of the back panel;

a triangulated hinged retainer selectively bracing an angle between the front panel and the back panel, the retainer facing the top surfaces of each panel;

a retainer support disposed on the top surface of an approximate center of the front panel, the retainer support at a height equal to that of the top of the elbow, a plurality of cutouts disposed within each side of the back panel;

at least two elastic resistance devices, one of each resistance device removably anchored within one of each of the opposing sides of the back panel, each resistance device anchored via at least one of the cutouts of the side of the back panel;

means for grasping and hooking each resistance device to a user, whereby resistance to a user's physical movement is provided;

a wedge slot disposed proximal to each side of the front panel, each slot disposed within the bottom surface of the front panel, each slot decreasing in depth as each slot becomes more proximal to the center of the front panel;

at least two wedges, each wedge of like shape to each slot, one of each wedge removably and selectively inserted as chosen into each slot, a retaining cord retaining each wedge against loss, each retaining cord fastened to one of the wedges and one of each opposing side of the front panel;

padding disposed on front surface of the back panel;

padding disposed on the top surface of the front panel.

14. The apparatus in claim 13 wherein at least one non-skid is disposed on the bottom surface of the front panel.

15. The apparatus in claim 14 wherein a carry handle is disposed proximal to the bottom of the front panel.

16. The apparatus in claim 15 wherein a closure strap is used for holding the apparatus in a closed position, the closure strap fastened to at least one of the top or front panels and secured to the opposing panel via hook and loop.

* * * * *